US008094077B2

(12) United States Patent
Yanagi et al.

(10) Patent No.: US 8,094,077 B2
(45) Date of Patent: Jan. 10, 2012

(54) ANTENNA APPARATUS AND ELECTRONIC APPARATUS

(75) Inventors: Masahiro Yanagi, Shinagawa (JP); Shigemi Kurashima, Shinagawa (JP); Hideki Iwata, Shinagawa (JP); Takashi Yuba, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 779 days.

(21) Appl. No.: 11/717,187

(22) Filed: Mar. 13, 2007

(65) Prior Publication Data

US 2008/0042906 A1 Feb. 21, 2008

(30) Foreign Application Priority Data

Aug. 18, 2006 (JP) ..... 2006-222849

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846

See application file for complete search history.

(56) References Cited

U.S. PATENT DOCUMENTS

| | | | | |
|---|---|---|---|---|
| 6,816,128 | B1 * | 11/2004 | Jennings | 343/915 |
| 7,071,877 | B2 * | 7/2006 | Okado | 343/700 MS |
| 7,158,089 | B2 * | 1/2007 | Mohammadian et al. | 343/795 |
| 7,365,698 | B2 * | 4/2008 | Dwyer et al. | 343/792 |
| 7,408,513 | B1 * | 8/2008 | Yanagi et al. | 343/700 MS |
| 2005/0195119 | A1 | 9/2005 | Gaucher et al. | |
| 2005/0280580 | A1 * | 12/2005 | Lin | 343/700 MS |
| 2007/0210965 | A1 * | 9/2007 | Takada et al. | 343/700 MS |

FOREIGN PATENT DOCUMENTS

| | | |
|---|---|---|
| JP | 9-223921 | 8/1997 |
| JP | 2000-196327 | 7/2000 |
| JP | 2005-260365 | 9/2005 |
| JP | 2005-286997 | 10/2005 |
| JP | 2005-341265 | 12/2005 |
| JP | 2006-19981 | 1/2006 |
| JP | 2006-33069 | 2/2006 |
| JP | 2006-121189 | 5/2006 |
| JP | 2007-535836 | 12/2007 |

OTHER PUBLICATIONS

Notice of Allowance for U.S. Appl. No. 12/324,276 mailed Apr. 27, 2011.

Japanese Office Action issued mailed Jun. 1, 2010 and issued in corresponding Japanese Patent Application 2006-222849.

* cited by examiner

*Primary Examiner* — Tan Ho

(74) *Attorney, Agent, or Firm* — Staas & Halsey LLP

(57) ABSTRACT

A disclosed antenna apparatus includes a dielectric flexible base having an element pattern and a ground pattern formed thereon. The dielectric flexible base has a cylindrical shape encompassing an antenna axis. The element pattern and the ground pattern formed on the dielectric flexible base are symmetrically formed with respect to the antenna axis.

6 Claims, 19 Drawing Sheets

α : 300 DEGREES
γ : 390 DEGREES
β : 450 DEGREES

α : 300 DEGREES
γ : 390 DEGREES
β : 450 DEGREES

W1 : 16mm
A1 : 15mm

α : 300 DEGREES
γ : 390 DEGREES
β : 450 DEGREES

α : 300 DEGREES
γ : 390 DEGREES
β : 450 DEGREES 110
105
132
106
120
133

102

110
105
106
120
110
102

201
203
202

205

110D

ANTENNA APPARATUS AND ELECTRONIC APPARATUS

BACKGROUND OF THE INVENTION

1. Field of the Invention

The present invention generally relates to an antenna apparatus and an electronic apparatus, and more particularly to an antenna apparatus using UWB and an electronic apparatus including the antenna apparatus.

2. Description of the Related Art

In recent years and continuing, a wireless communication technology using UWB (Ultra-Wide Band) is drawing attention for its ability to perform radar positioning and large capacity communications. In 2002, the U.S. Federal Communication Commission (FCC) approved the use of the UWB in a frequency band of 3.1-10.6 GHz.

The UWB is a communications technology for communicating pulse signals in an ultra wide band. Therefore, an antenna used for UWB is desired to have a configuration that allows transmission/reception in an ultra wide band.

As for an antenna to be used in the frequency band of 3.1-10.6 GHz approved by the FCC, an antenna having an earth plate and a feeder member (power supply member) is proposed (See Institute of Electronics, Information and Communication Engineers, B-1-133, "Horizontal In-Plane Non-Directional/Low VSWR Antenna for FCC Approved UWB", Takuya Taniguchi, Takehiko Kobayashi, Tokyo Denki University, Classroom B201, Presented on Mar. 22, 2003).

FIGS. 1A and 1B are schematic drawings showing conventional antenna apparatuses.

FIG. 1A shows an antenna apparatus 10 having an inverted circular cone-shaped feeder member 12 situated on an earth plate 11.

The side plane of the circular cone-shaped feeder member 12 is configured to form an angle of θ degrees with respect to the surface of the earth plate 11. A desired property can be obtained by adjusting the angle.

FIG. 1B shows another antenna apparatus 20 having a droplet (teardrop) shaped feeder member 22 situated on the earth plate 11. The feeder member 22 includes a circular cone part 22*a* and a sphere part 22*b* inscribed to the circular cone part 22*a*.

Since the conventional antenna apparatuses 10, 20 are configured having a circular cone shape or a teardrop shape feeder member 12, 22 on a flat earth plate 11, the conventional antenna apparatuses 10, 20 have a relatively large size. Accordingly, it is desired to fabricate an antenna apparatus having a smaller and thinner size.

FIGS. 2A and 2B show a flat UWB antenna apparatus 30 (hereinafter referred to as "UWB antenna apparatus 30") of a related art case of the applicant (Japanese Patent Application No. 2006-91602). The flat UWB antenna apparatus 30 has a base 31 formed of a dielectric material. The base 31 has an upper surface 31*a* on which an antenna element pattern 32, a strip line 33, and two ground patterns 34, 35 are formed. Furthermore, a coaxial connector 50 is mounted on an edge of the base 31. The UWB antenna apparatus 30 is a monopole type antenna which can be fabricated in a small thin size. In FIGS. 2A and 2B, "Z" indicates the direction of the axis line of the monopole, "X" indicates the width direction of the UWB antenna apparatus 30, and "Y" indicates the thickness direction of the UWB antenna apparatus 30.

The UWB antenna apparatus 30 has a coplanar line type microwave transmission line 40 which is formed by connecting the strip line 33, the ground patterns 34, 35, and the base 31. The coaxial connector 50 is fixed to one end of the microwave transmission line 40 by being soldered to the strip line 33 and the ground patterns 34, 35.

Since the UWB antenna apparatus 30 is thin, the UWB antenna apparatus 30 can be assembled within narrow-spaced areas inside electronic devices to thereby allow wireless communications between electronic devices, for example, inside the same room of an office.

In one example, the inventor of the present invention has experimented assembling the UWB antenna apparatus 30 in a laptop personal computer 60 (as shown in FIG. 3A). Here, a liquid crystal display apparatus 65 is pivotally movably mounted on the further edge of a main body of the laptop personal computer 60 with a hinge 64 for enabling the laptop personal computer 60 to be opened and closed. The liquid crystal display apparatus 65 has a liquid crystal panel 67 assembled to a frame 66. Taking the characteristics (e.g., transmission/reception characteristics) of the UWB antenna apparatus 30 into consideration, the UWB antenna apparatus 30 is mounted on an edge part inside the liquid crystal display apparatus 65.

In this example, the width W1 of the frame 66 of the liquid crystal apparatus 65 is reduced as much as possible for increasing the size of a liquid crystal panel 67 of the liquid crystal apparatus 65. This reduction of the width W1 causes a large part of the UWB antenna apparatus 30 to overlap with the liquid crystal panel 67.

Since the liquid crystal panel 67 has a characteristic of blocking radio waves, the UWB antenna 30 can neither sufficiently transmit radio waves 70 in the front direction of the liquid crystal panel 67 nor sufficiently receive radio waves 80 coming from the front direction of the liquid crystal panel 67, as shown in FIG. 3B. Thus, it is desired to enable the UWB antenna apparatus 30 to perform communications more satisfactorily.

SUMMARY OF THE INVENTION

It is a general object of the present invention to provide an antenna apparatus and an electronic apparatus that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an antenna apparatus and an electronic apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an antenna apparatus including: a dielectric flexible base having an element pattern and a ground pattern formed thereon; wherein the dielectric flexible base has a cylindrical shape encompassing an antenna axis; wherein the element pattern and the ground pattern formed on the dielectric flexible base are symmetrically formed with respect to the antenna axis.

Furthermore, another embodiment of the present invention provides an antenna apparatus including: a dielectric flexible base having an element pattern and a ground pattern formed thereon; wherein the dielectric flexible base has a notch part formed between the element pattern and the ground pattern enabling the element pattern to bend separately with respect to the ground pattern.

Furthermore, another embodiment of the present invention provides an electronic apparatus including: the antenna apparatus according to the embodiment of the present invention.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 4A:
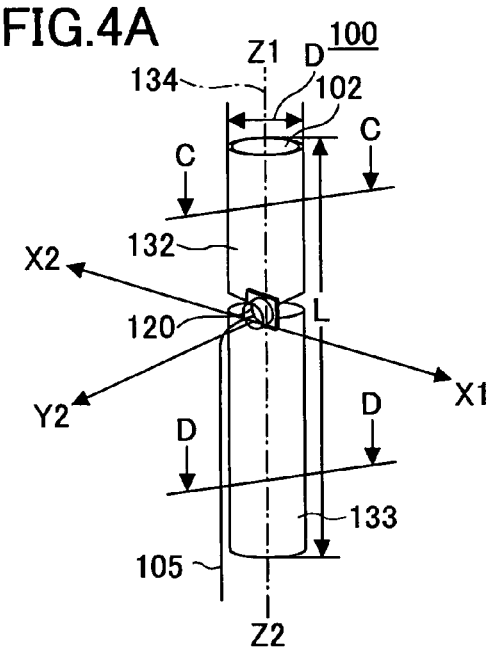
FIGS. 4A-4E are schematic diagrams showing a UWB antenna apparatus according to a first embodiment of the present invention.
Figure 4B:
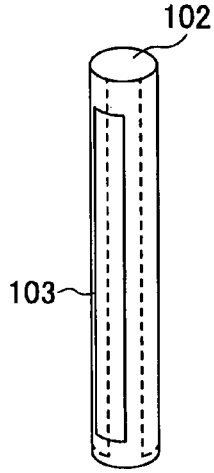
Figure 4C:
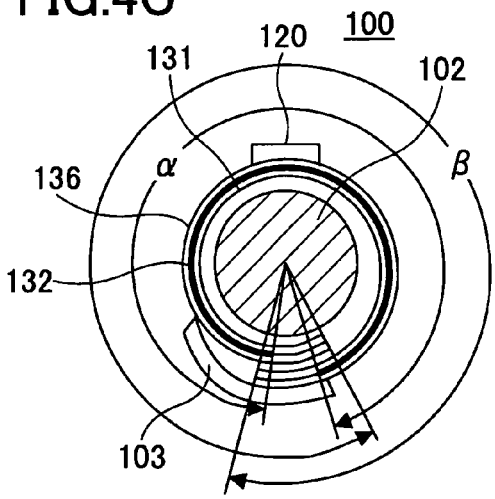
Figure 4D:
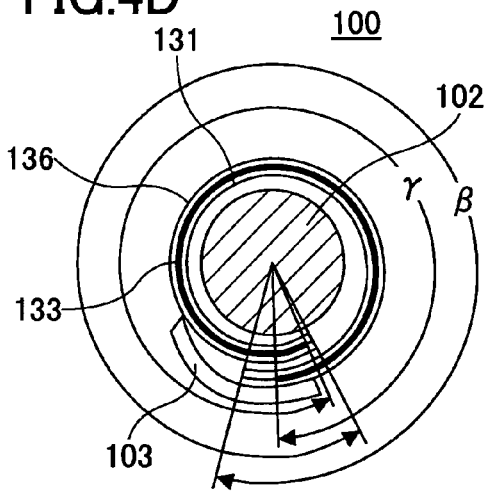
Figure 4E:
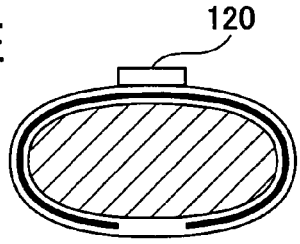

FIGS. 4A-4E are schematic diagrams showing a cylinder type UWB antenna apparatus 100 (hereinafter referred to as "UWB antenna apparatus 100") according to a first embodiment of the present invention. More specifically, FIG. 4A is a front view of the UWB antenna apparatus 100, FIG. 4B is a rear view of the UWB antenna apparatus 100, FIG. 4C is an enlarged cross-sectional view of the UWB antenna apparatus 100 taken along line C-C of FIG. 4A, and FIG. 4D is an enlarged cross-sectional view of the UWB antenna apparatus 100 taken along line D-D of FIG. 4A. In FIGS. 4A-4E, thickness is illustrated in an exaggerated manner for the sake of convenience.

Figure 6A:
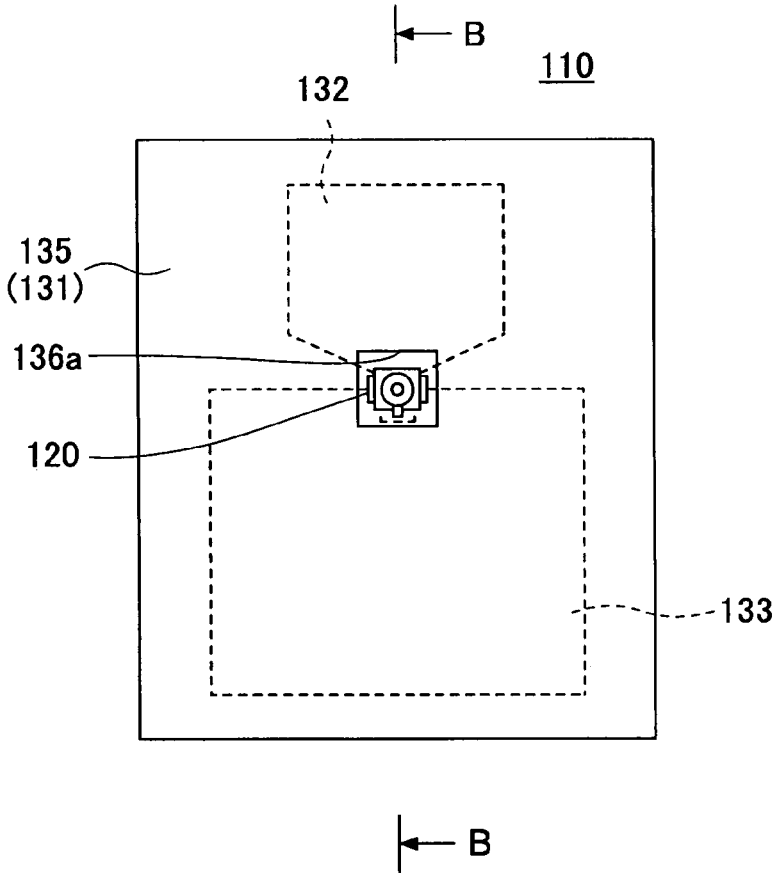
FIGS. 6A and 6B are schematic diagrams showing a flat UWB antenna according to an embodiment of the present invention.
Figure 6B:
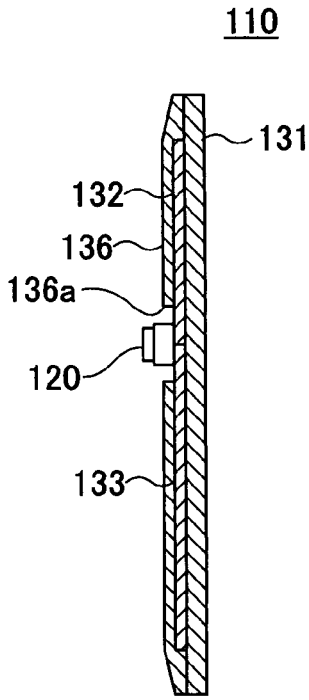
Figure 7:
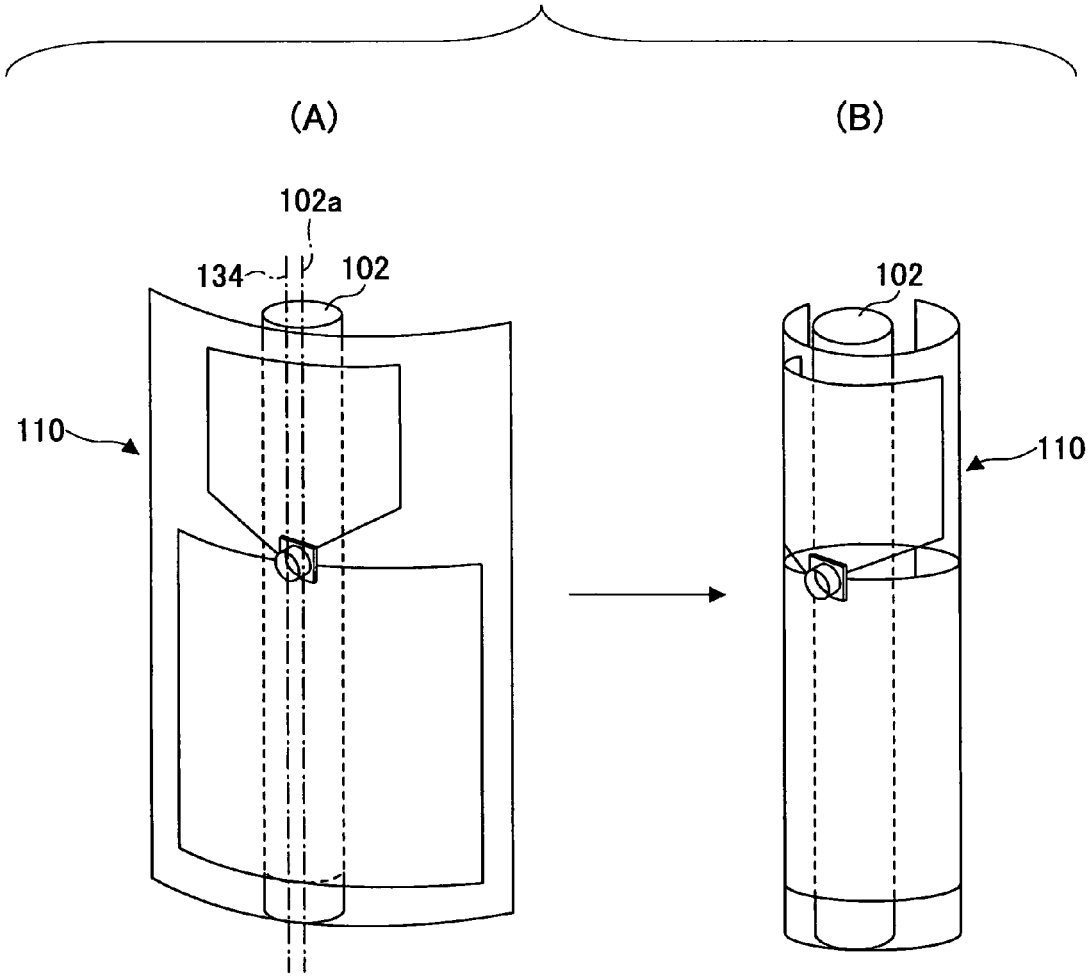
FIG. 7 is a diagram for describing a process of manufacturing a UWB antenna apparatus according to an embodiment of the present invention.

The UWB antenna apparatus 100 according to the first embodiment of the present invention has a flat UWB antenna 110 (see FIGS. 6A and 6B) wrapped around a core member 102 as shown in FIG. 7 and adhered to the core member 102 with an adhesive tape 103 as shown in FIG. 4B. The core member 102 having a cylindrical shape is made of, for example, ABS material or Teflon® material. In this example, the core member 102 has a diameter D of 6 mm. Furthermore, the flat UWB antenna 110 has a coaxial cable 105 (see FIG. 4A) drawn out therefrom. It is to be noted that a double face adhesive tape or an adhesive agent may be alternatively used for adhering the flat UWB antenna 110 to the core member 102.

In the UWB antenna apparatus 100, the inventors of the present invention found that antenna characteristics of the UWB antenna apparatus 100 having the above-described configuration are not adversely affected even where the flat UWB antenna 110 shown in FIG. 6A is rolled into a cylindrical form as shown in FIG. 7.

With reference to FIGS. 4A-4E, the UWB antenna apparatus 100, which includes a cylindrical base 131(formed of, for example, polyimide), a single cylindrical antenna element pattern (monopole) 132, a single cylindrical ground element pattern 133, and a socket type coaxial connector 120 situated between the cylindrical antenna element pattern 132R and the cylindrical ground element pattern 133, is configured as a monopole type antenna having the cylindrical antenna element pattern 132 and the cylindrical ground element pattern 133 aligned next to each other along a single antenna axis line (monopole axis line) 134. The cylindrical antenna element pattern 132 and the cylindrical ground pattern 133 have substantially equal curvature throughout their entire lengths, that is, the cylindrical antenna element pattern 132 and the cylindrical ground element pattern 133 are symmetrically curved with respect to the antenna axis line 134.

Figure 1A:
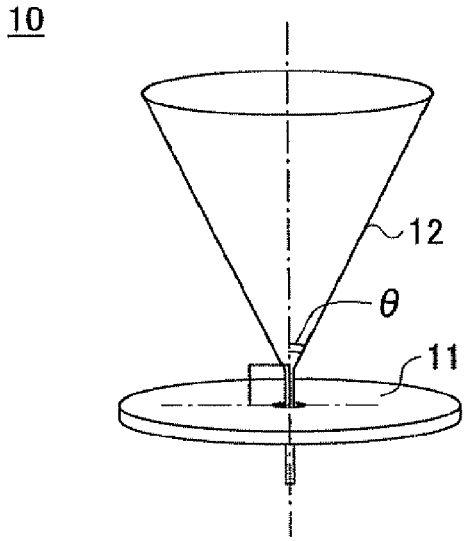
FIG.1A PRIOR ART
FIGS. 1A and 1B are schematic diagrams showing configurations of conventional antenna apparatuses.
Figure 1B:
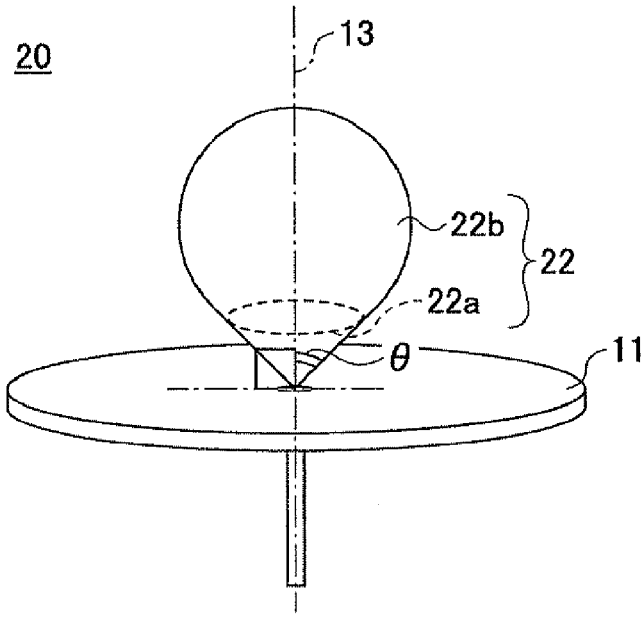
FIG.1B PRIOR ART
Figure 2A:
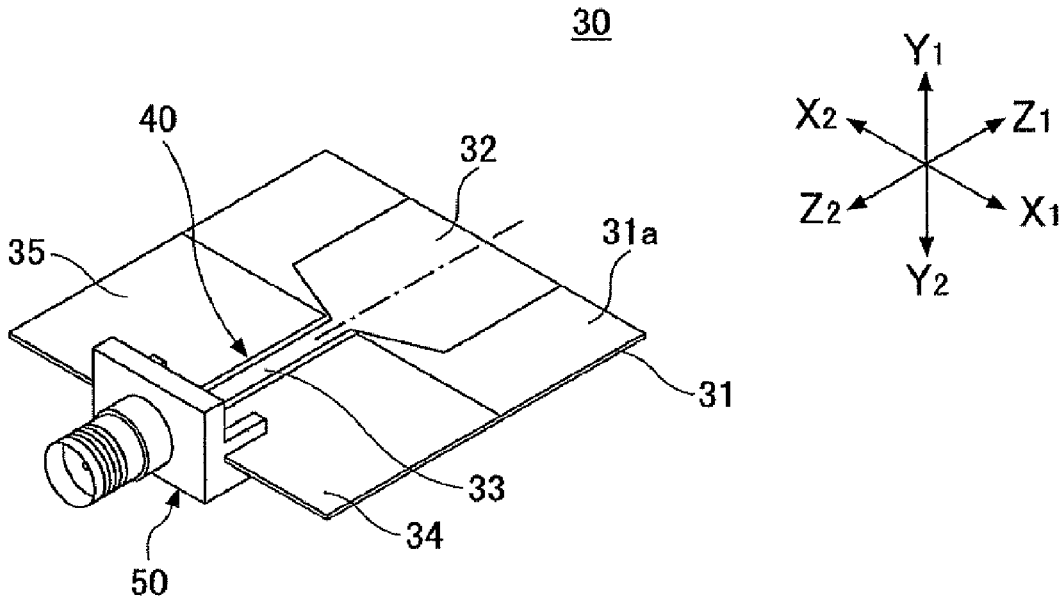
FIG.2A PRIOR ART
FIGS. 2A and 2B are schematic diagrams showing configurations of a flat UWB antenna apparatus according to a related art case of the applicant.
Figure 2B:
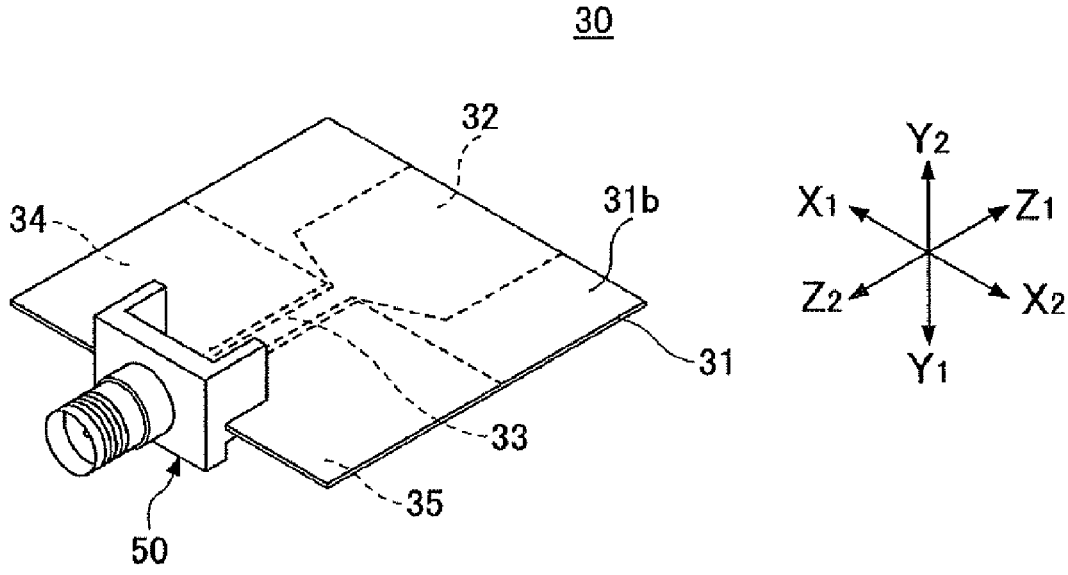
FIG.2B PRIOR ART
Figure 3A:
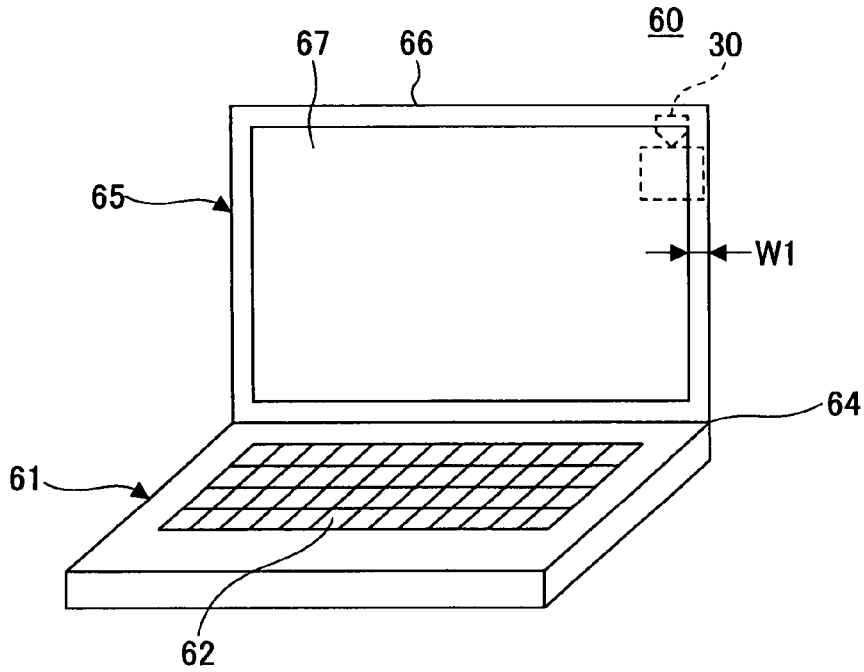
FIGS. 3A and 3B are schematic diagrams for describing a case where the flat UWB antenna apparatus is assembled in a laptop type personal computer having a liquid crystal display apparatus.
Figure 3B:
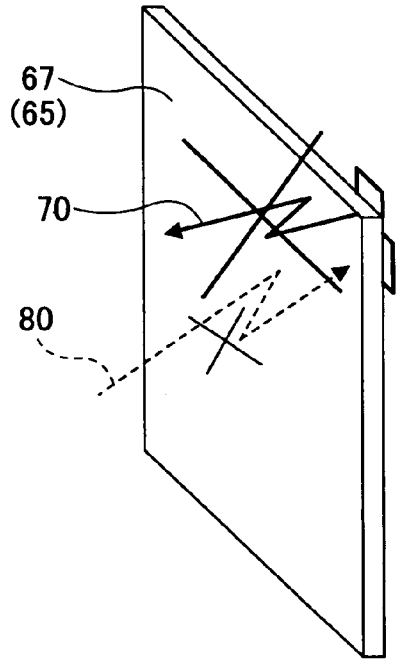

In this example, the UWB antenna apparatus 100 has a length L of approximately 40 mm and a relatively short diameter D of 6 mm. Accordingly, the UWB antenna apparatus 100 is significantly small in size compared to the UWB antenna apparatus 30 of the related art case shown in FIGS. 2A and 2B.

Figure 5A:
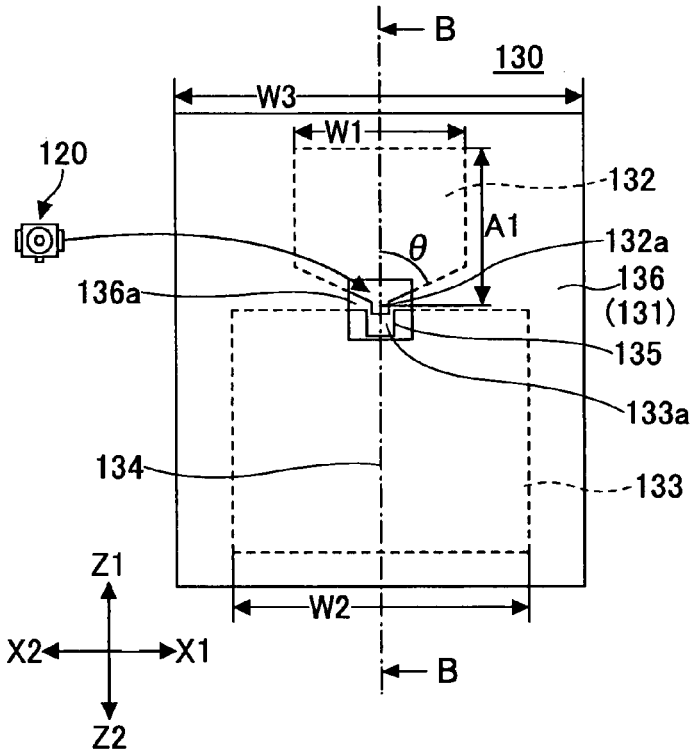
FIGS. 5A-5C are schematic diagrams showing a main body of a UWB antenna apparatus according to an embodiment of the present invention.
Figure 5B:
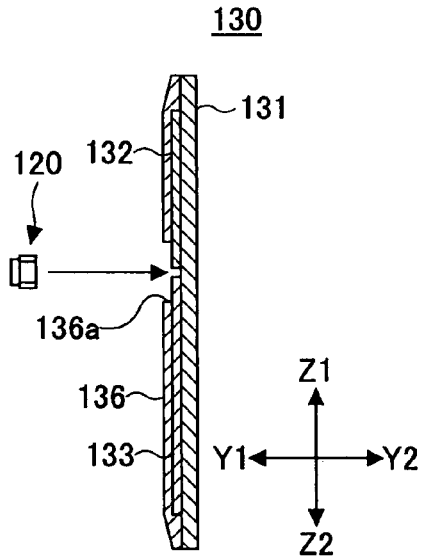
Figure 5C:
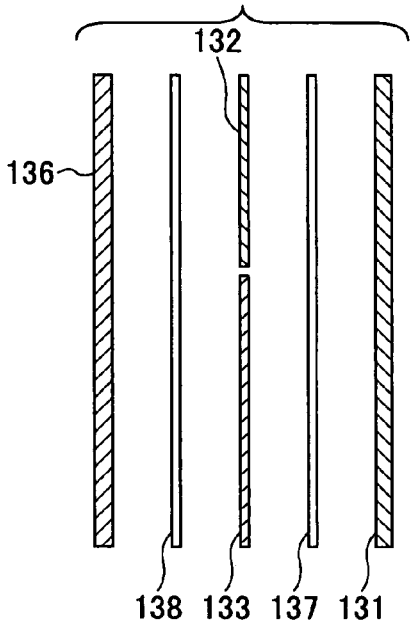

With reference to FIGS. 5A-5C, the flat UWB antenna 110 has the socket type coaxial connector 120 mounted on a surface of its main body (UWB antenna main body) 130.

The UWB antenna main body 130 has the antenna element pattern 132 and the ground pattern 133 formed on an upper surface of the base 131 (in this example, the base 131 has a thickness of approximately 0.1 mm) along the antenna axis line (monopole axis line) 134. The pattern of the antenna element pattern 132 and the ground pattern 133 are formed by using, for example, an etching method. Furthermore, the upper surfaces of the antenna element pattern 132 and the ground pattern 133 are covered by a cover lay 136 formed of, for example, polyimide material.

Both the base 131 and the cover lay 136 are dielectric materials having a flexibility property. The antenna element pattern 132 and the ground pattern 133 are formed of, for example, rolled copper.

The antenna element pattern 132 and the ground pattern 133 are adhered to the base 131 by using an epoxy type adhesive agent 137. The cover lay 136 is also adhered to the base 131, the antenna element pattern 132, and the ground pattern 133 by using an epoxy type adhesive agent 138.

The UWB antenna main body 130 having the above-described configuration provides satisfactory flexibility in which the UWB antenna main body 130 can be bent exhibiting a small curvature radius of approximately 3 mm with respect to the antenna axis line 134.

Alternatively, the cover lay 136 may be formed of polyester material, and the antenna element pattern 132 and the ground pattern 133 may be formed of electrolytic copper. Furthermore, other than the epoxy type adhesive agents 137, 138, a polyurethane type adhesive agent or an acryl type adhesive agent may be alternatively used.

As shown in FIG. 5A, the antenna element pattern 132 is formed in a shape similar to a baseball home plate. The antenna element pattern 132 has a protruding part (feeding point) 132*a* having an open angle θ of approximately 60 degrees. A strip line 135, having a considerably short length, is formed extending from the protruding part (feeding point) 132*a* in a Z2 direction. In this example, the strip line 135 has a length of approximately 1 mm. The ground pattern 133 is formed in a square shape. The ground pattern 133 is situated closely to the protruding part (feeding point) 132*a* of the antenna element pattern 132 in a manner facing the antenna element pattern 132. The ground pattern 133 has a concave part 133*a* facing the feeding point of the antenna element pattern. The strip line 135 is positioned inside the concave part 133*a*.

As shown in FIGS. 5A and 5B, a window opening 136*a* formed in the cover lay 136, thereby exposing an area including the periphery of the concave part 133*a* of the ground pattern 133 and the strip line 135. The exposed area of the window opening 136*a* serves as a coplanar type microwave transmission path having an impedance of 50 Ω.

In FIG. 5A, the width of the antenna element pattern 132 is indicated as "W1", the width of the ground pattern 133 is indicated as "W2", and the width of the base 131 is indicated as "W3". The width "W1" and width "W2" satisfy a relationship of "W1<W2". The width "W1", the width "W2" and the width "W3" satisfy a relationship of "W1<W2<W3". In this example, the width "W1" of the antenna element 133 is 16 mm and the length of the antenna element "A1" is 15 mm.

Figure 8A:
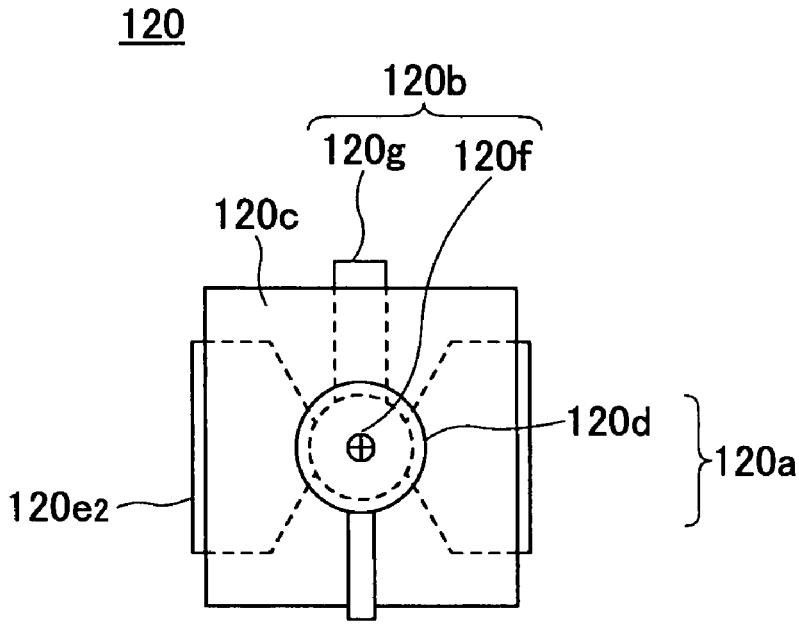
FIGS. 8A-8C are schematic diagrams showing a socket type coaxial connector according to an embodiment of the present invention.
Figure 8B:
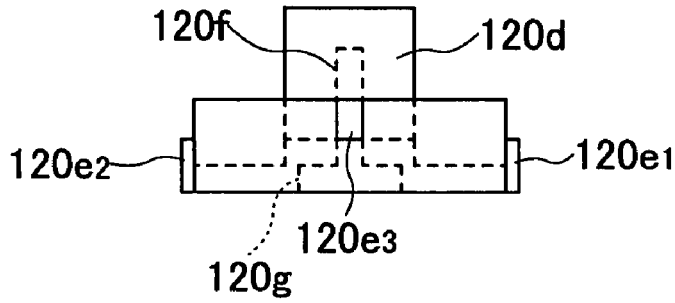
Figure 8C:
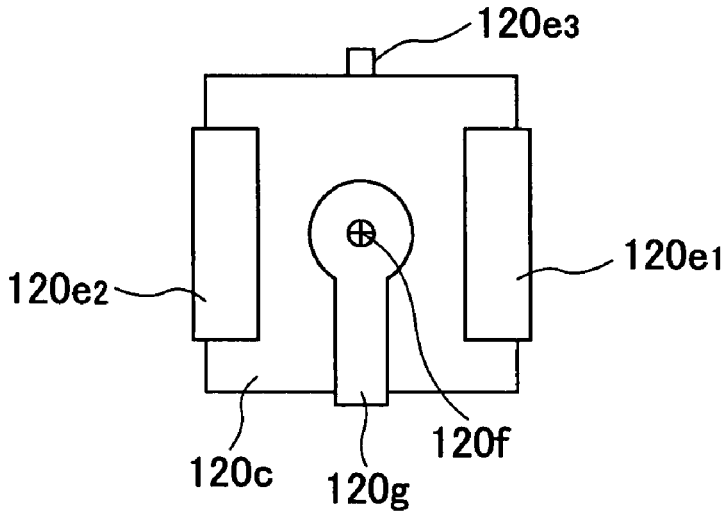

With reference to FIGS. 8A, 8B, and 8C, the socket type coaxial connector 120 is a surface mountable type connector having a shield part 120*a*, a signal line connection part 120*b*, and an insulation part 120*c* integrally molded into a united body.

The shield part 120*a*, which is formed of a conductive material, includes a connection part 120*d* and contact parts 120*e*1, 120*e*2, and 120*e*3. The connection part 120*d*, which is formed with a substantially cylindrical shape extending in the Z1 direction, is configured to engage a shield of a plug connector (not shown).

The contact parts 120*e*1, 120*e*2, and 120*e*3, which are connected to the connection part 120*d*, are exposed at a bottom surface of the insulation part 120*c*.

The signal connection part 120*b*, which is formed of a conductive material, includes a center conductor (connection pin) 120*f* and a contact part 120*g*. The center conductor 120*f*, which extends from the insulation part 120*c* towards an inner periphery of the connection part 120*d*, is to be connected to a signal line of a plug connector (not shown) when connecting the socket type coaxial connector 120 to the plug connector. The contact part 120*g*, which is connected to the center conductor 120*f*, is exposed at a bottom surface of the insulation part 120*c*.

The socket type coaxial connector 120 having the above-described configuration is mounted on the surface of the ground pattern 133 by soldering the contact part 120*g* to an end part of the strip line 135 and soldering the contact parts 120*e*1, 120*e*2 to the concave part 133*a* of the ground pattern 133.

In fabricating the UWB antenna apparatus 100, the part of the flat UWB antenna 110 corresponding to the axis line 134 is placed against the core member 102 in a manner having the axis line 134 positioned parallel to an axis line 102*a* of the core member 102 and the socket type coaxial connector 120 facing outward as shown in FIG. 7A. Then, as shown in FIG. 7B, the flat UWB antenna 110 is wrapped around the core member 102 in a manner where two sides of the flat UWB antenna 110 in the X direction are symmetrical (even) having the axis line 134 as their center. The flat UWB antenna 110 is fixed to the core member 102 with, for example, an adhesive tape to prevent the flat UWB antenna 110 from loosening.

The diameter D of the core member 102 is defined in accordance with the width W1 of the antenna element pattern 132. As shown in FIG. 4C, the wrapping angle (arc angle) α of the antenna element pattern 132 is 360 degrees or less. For example, the wrapping angle (arc angle) α of the antenna element pattern 132 may be approximately 300 degrees.

With reference to FIGS. 4A-4D, the wrapping angle (arc angle) β of the cylindrical base 131 is greater than 360 degrees (e.g., approximately 450 degrees) where both ends of the cylindrical base 131 are overlapped. Since the wrapping angle (arc angle) α of the cylindrical antenna element pattern 132 in this example is 300 degrees, both ends of the antenna element pattern 132 are not overlapped.

The wrapping angle (arc angle) γ of the cylindrical ground pattern 133 is slightly greater than 360 degrees (in this example, 390 degrees) where both ends of the cylindrical ground pattern 133 are overlapped. However, since an insulation film 136 is interposed at the overlapped area, the overlapped area is electrically insulated.

Next, operations and characteristics of the cylindrical UWB antenna apparatus 100 according to the first embodiment of the present invention are described.

The UWB antenna apparatus 100 may be used in a frequency bandwidth of 3-6 GHz in a manner having a coaxial connector (not shown) on one end of the coaxial cable 105 extending from the antenna apparatus 100 connected to the socket type coaxial connector 120. In the UWB antenna apparatus 100, the antenna element pattern 132 receives high frequency signals and the ground pattern 133 serves as ground potential. Thereby, a line of electric force is formed between the antenna element pattern 132 and the ground pattern 133. Thus, radio waves can be emitted from the UWB antenna apparatus 100.

FIGS. 9A-9D are for describing the characteristics of the UWB antenna apparatus 100 according to the first embodiment of the present invention.

Figure 9A:
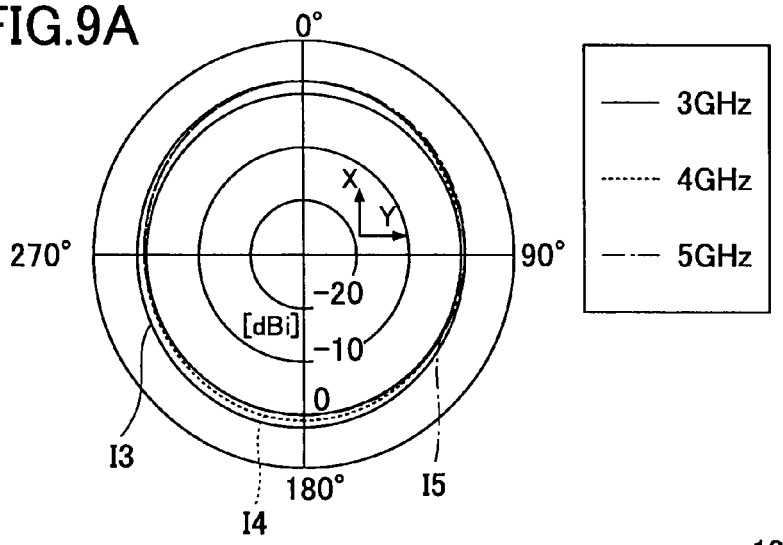
FIGS. 9A-9D are diagrams for describing characteristics of a UWB antenna apparatus according to an embodiment of the present invention.
Figure 9D:
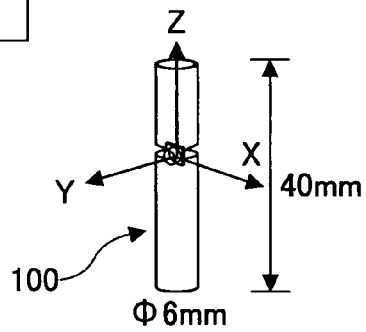
Figure 9B:
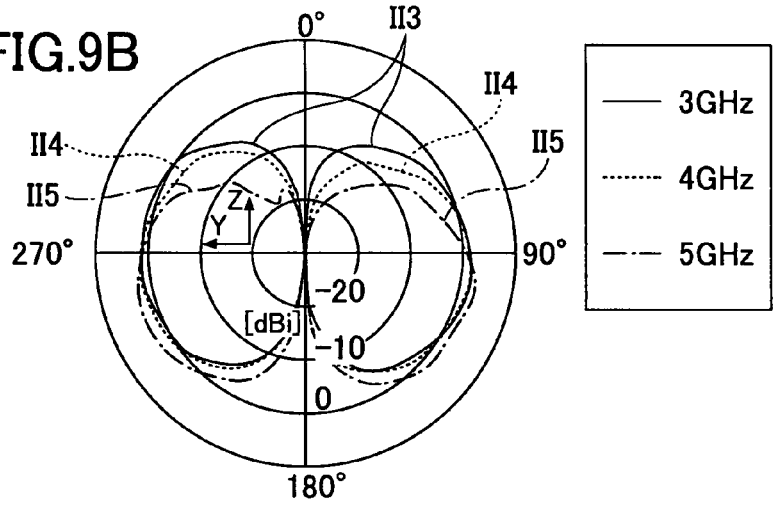
Figure 9C:
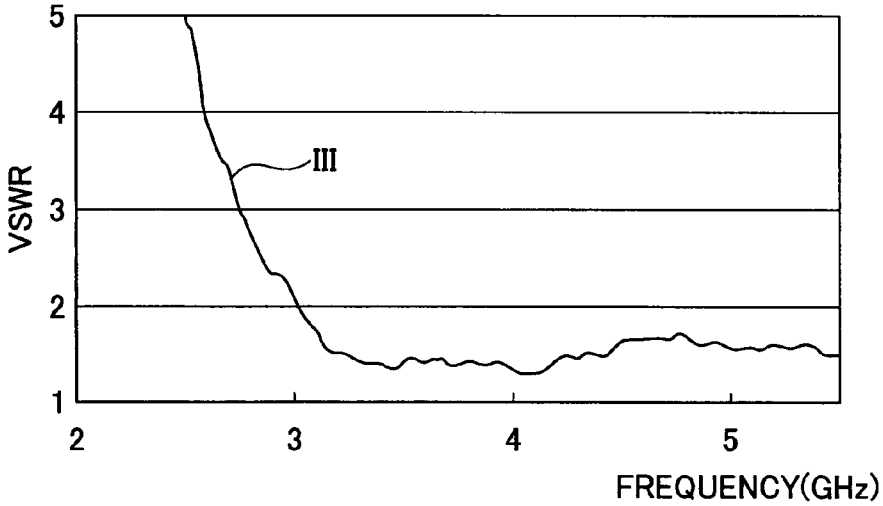
Figure 10A:
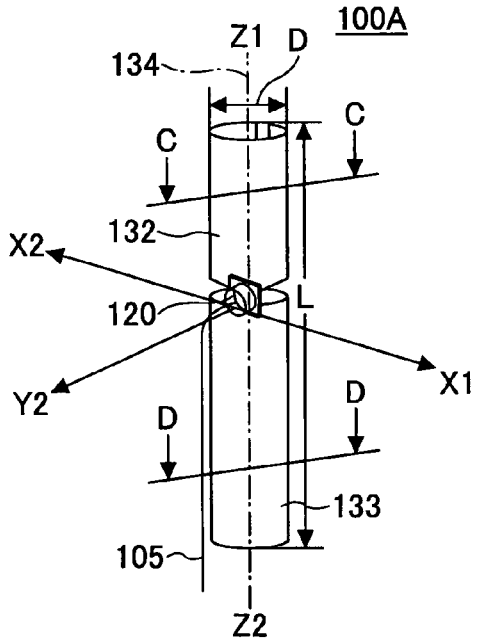
FIGS. 10A-10D are schematic diagrams showing a UWB antenna apparatus according to a second embodiment of the present invention.
Figure 10B:
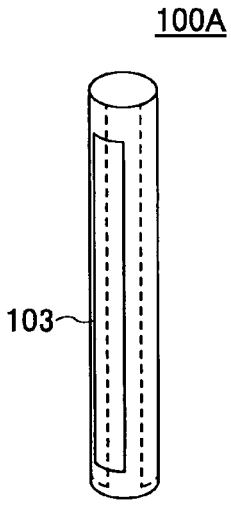
Figure 10C:
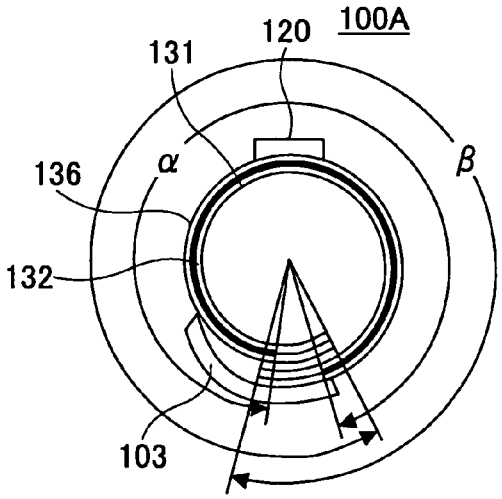
Figure 10D:
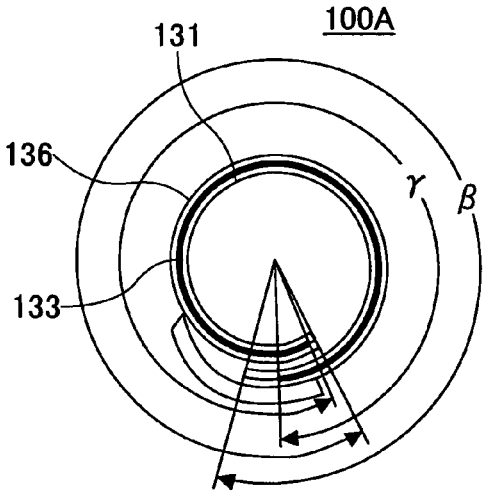

FIG. 9A shows X-Y in-plane directivity of the UWB antenna apparatus 100. FIG. 9B shows Y-Z in-plane directivity of the UWB antenna apparatus 100. In FIGS. 9A and 9B, lines "I3" and "II3" indicate signal directivity in a frequency band of 3 GHz, lines "I4" and "II4" indicate signal directivity in a frequency band of 4 GHz, and lines "I5" and "II5" indicate signal directivity in a frequency band of 5 GHz. In FIG. 9C, line "III" shows frequency characteristics in relation with VSWR (Voltage Standing Wave Ratio). FIG. 9D is a schematic diagram showing the dimensions of the UWB antenna apparatus 100.

As shown in FIGS. 9A-9D, in a frequency bandwidth of 3-5 GHz, the UWB antenna apparatus 100 exhibits characteristics suitable for practical use including an X-Y in-plane directivity having an omnidirectional property and a VSWR equaling approximately 1.7 or less.

It is to be noted that the cross section of the antenna element pattern 132 and the ground pattern 133 are not limited to a circular shape but may also be an elliptical shape. Furthermore, their cross sections are not limited to a closed-loop shape but may also be an open-loop shape such as a U-shape or a partly disconnected circular or elliptical shape.

Second Embodiment

Another cylindrical UWB antenna apparatus 100A (hereinafter referred to as "UWB antenna apparatus 100A") according to a second embodiment of the present invention is shown in FIGS. 10A-10D. Here, the UWB antenna apparatus 100A has a core-less configuration in which the core member 102 is removed from the UWB antenna apparatus 100 of the first embodiment shown in FIGS. 4A-4E.

The characteristics exhibited by the UWB antenna apparatus 100A according to the second embodiment of the present invention is substantially the same as those of the UWB antenna apparatus 100B according to the first embodiment of the present invention.

Third Embodiment

Another cylindrical UWB antenna apparatus 100B (hereinafter referred to as "UWB antenna apparatus 100B") according to a third embodiment of the present invention is shown in FIGS. 11A-11B.

As shown in FIG. 11A, although the UWB antenna apparatus 100B also has a cylindrical shape having a flat UWB antenna 110B encircling an axis line 134, the UWB antenna apparatus 110B has an antenna element pattern 132B different from that of the UWB antenna apparatus 110 shown in FIG. 6A. In comparison with the antenna element pattern 132 shown in FIG. 5A, the antenna element pattern 132B has a width W1 (X direction) equal to that of the antenna element pattern 132 but has a length A2 (Z direction) 10 mm longer than that of the antenna element pattern 132B. That is, the antenna element pattern 132B in this example has a length A2 of 25 mm. Accordingly, the ratio between the width W1 and the length A2 (A2/W1) is approximately 1.5.

Figure 12:
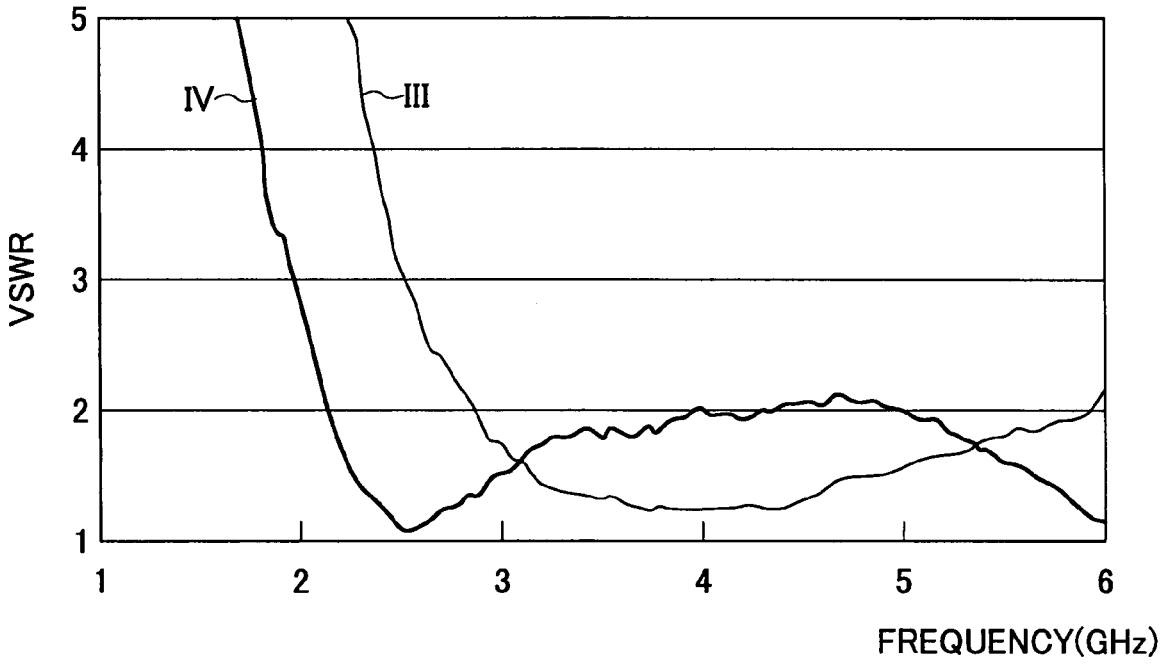
FIG. 12 is a diagram for describing characteristics of the UWB antenna apparatus shown in FIG. 11.

In measuring the characteristics of the UWB antenna apparatus 100B, the UWB antenna apparatus 100B exhibited VSWR characteristics indicated with line "IV" of FIG. 12. Compared to line "III", line "IV" shows that VSWR characteristics of 2.0 in a frequency of approximately 2.2 GHz and that the bandwidth having a VSWR lower than 2.0 is spread in a frequency range lower than that of the UWB antenna apparatus 100.

Figure 11:
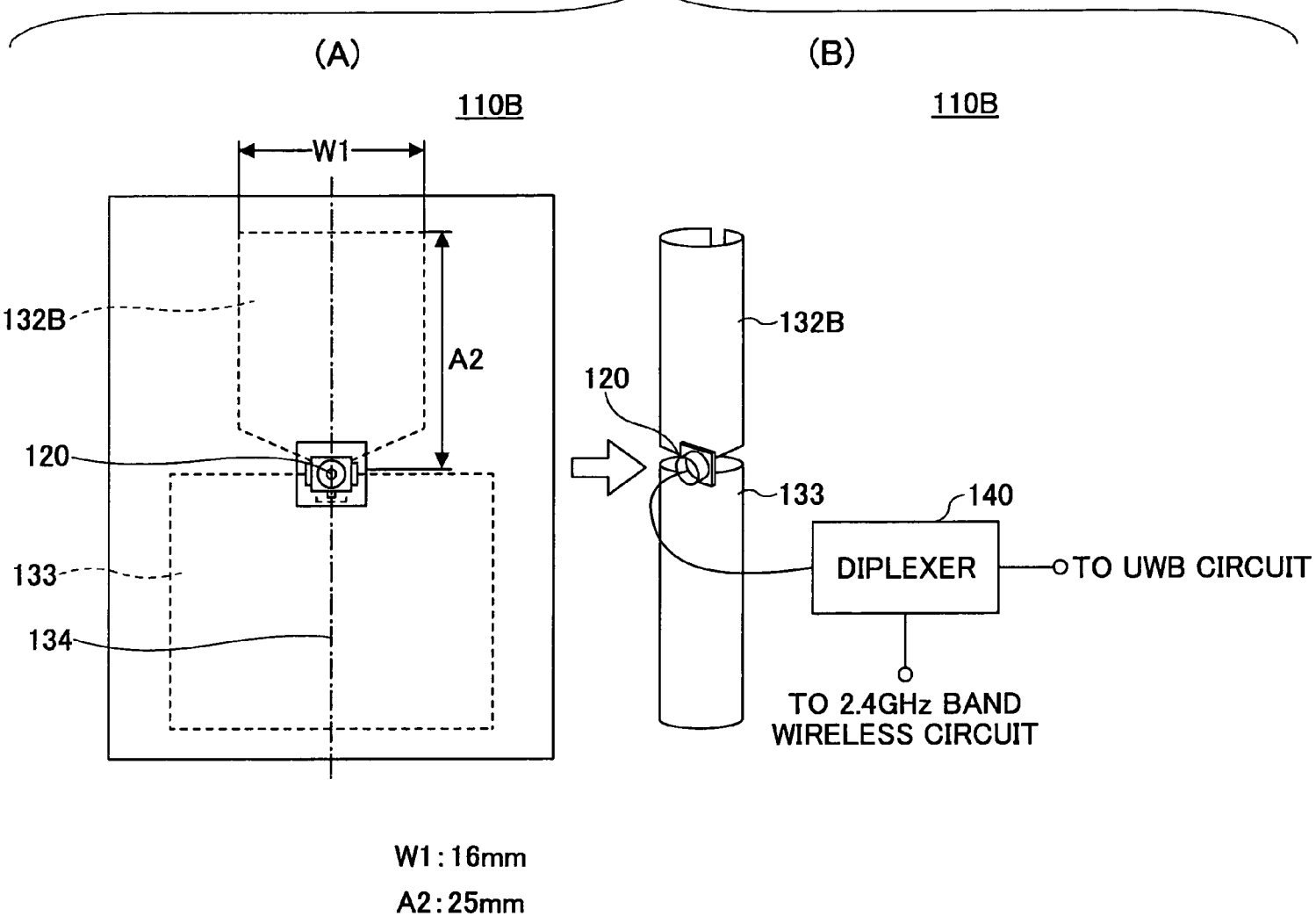
FIG. 11 is a schematic diagram showing a UWB antenna apparatus according to a third embodiment of the present invention.

Accordingly, the UWB antenna apparatus 100B is used by connecting an end of its coaxial cable 105 to a diplexer 140 as shown in (B) of FIG. 11. It is to be noted that the diplexer 140 is connected to a UWB circuit and a 2.4 GHz wireless circuit. Thereby, the UWB antenna apparatus 100B, in addition to being used as a UWB antenna, can also be used as an antenna for a wireless LAN of 2.4 GHz or for blue-tooth communications.

Fourth Embodiment

Figure 13:
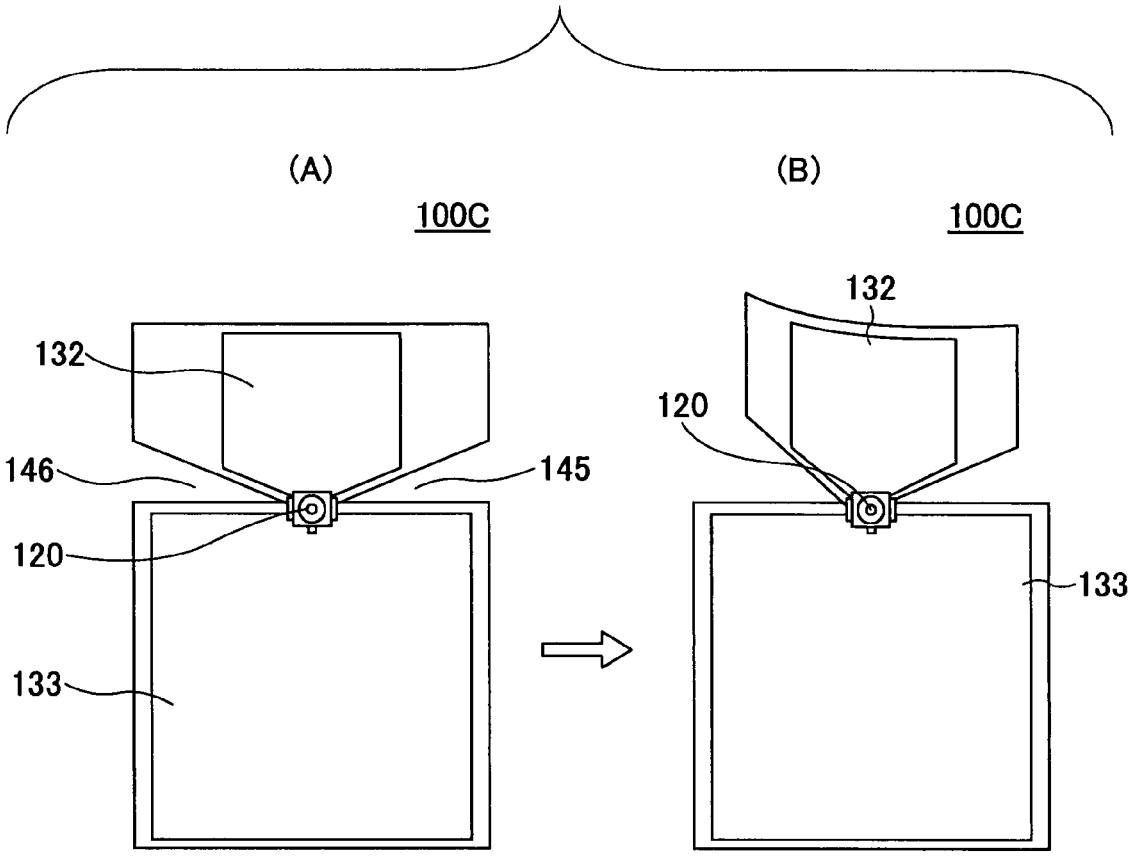
FIG. 13 is a schematic diagram showing a UWB antenna apparatus according to a fourth embodiment of the present invention.

Another cylindrical UWB antenna apparatus 100C (hereinafter referred to as "UWB antenna apparatus 100C") according to a fourth embodiment of the present invention is shown in FIG. 13.

The UWB antenna apparatus 100C has a configuration allowing the antenna element pattern 132 to be bent independently with respect to the ground pattern 133.

The UWB antenna apparatus 100C has triangular notch parts 145, 146 formed between the antenna element pattern 132 and the ground pattern 133 of the base 131 and the cover lay 136 as shown in FIG. 13A. Accordingly, the antenna element pattern 132 is connected to the ground pattern 133 at a center part between the notch parts 145, 146. Thus, the antenna element pattern 132 can be bent independently with respect to the ground pattern 133. This increases the degree of freedom in bending the antenna element pattern 132. Thereby, a satisfactory degree of freedom can be attained in assembling the UWB antenna apparatus 100C into an electronic apparatus.

Fifth Embodiment

Figure 14:
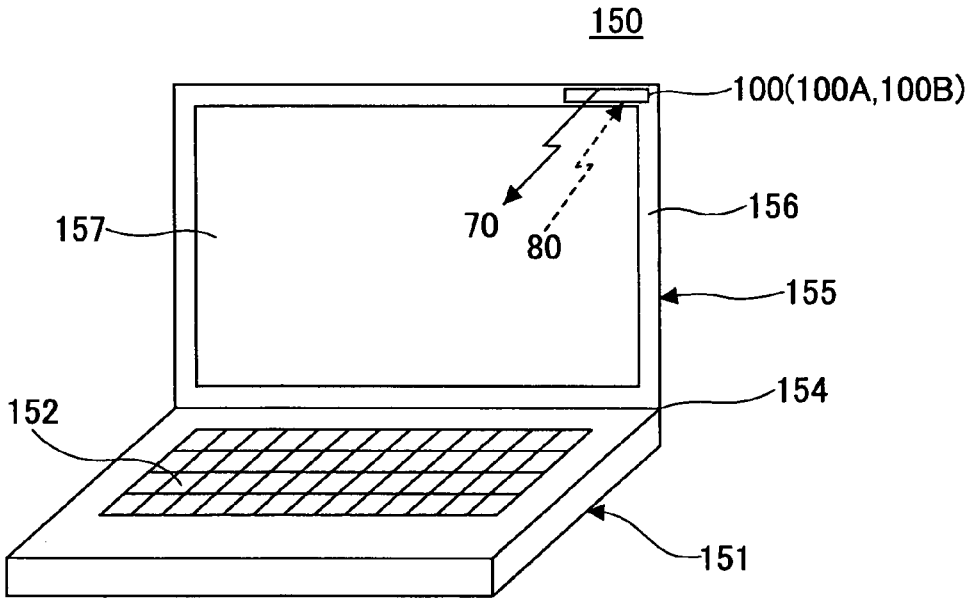
FIG. 14 is a schematic diagram showing a laptop type personal computer according to a fifth embodiment of the present invention.

FIG. 14 is a schematic diagram showing a laptop personal computer (electronic apparatus) 150 according to a fifth embodiment of the present invention. As shown in FIG. 14, the laptop computer 150 includes, for example, a main body 151, a keyboard 152 provided on an upper surface of the main body, a liquid crystal display apparatus 155 mounted to the main body 151, and the UWB antenna apparatus 100 (100A, 100B) mounted to the liquid crystal display apparatus 155. In the laptop personal computer 150, the liquid crystal display apparatus 155 is pivotally movably mounted on the further edge of a main body 151 of the laptop personal computer 150 with a hinge 154 for enabling the laptop personal computer 150 to be opened and closed. The liquid crystal display apparatus 155 has a liquid crystal panel 157 assembled to a frame 156. In FIG. 14, the UWB antenna apparatus 100, 100A, or 100B shown in FIG. 4, 10, or 11 is mounted sideways to a high part of the edge of the liquid crystal display apparatus 155 where the laptop personal computer 150 is in an upright state. By having the longitudinal side the UWB antenna apparatus 100, 100A or 100B oriented along the frame 156, the UWB antenna apparatus 100, 100A or 100B can be assembled in the laptop personal computer 150 without overlapping the liquid crystal panel 157 even in a case where the width of the frame 156 is narrow. This owes to the small size of the UWB antenna apparatus 100, 100B, or 100C having a diameter of approximately 6 mm.

Accordingly, transmission of radio waves 70 to the front direction of the liquid crystal panel 157 and reception of radio waves 80 from the front direction of the liquid crystal panel 157 can be prevented from being obstructed by the liquid crystal panel 157.

Sixth Embodiment

Figure 15:
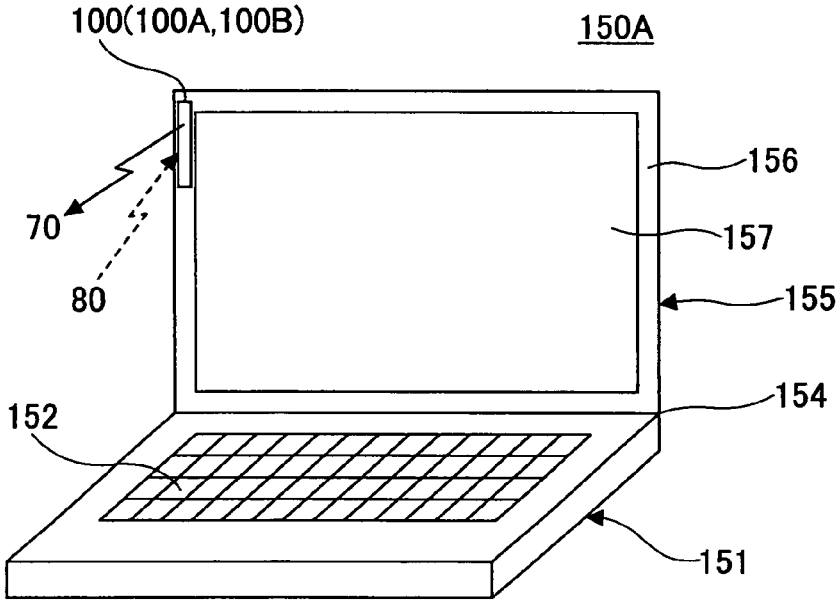
FIG. 15 is a schematic diagram showing a laptop type personal computer according to a sixth embodiment of the present invention.

FIG. 15 is a schematic diagram showing a laptop personal computer 150A according to a sixth embodiment of the present invention. The difference between the laptop computer 150A shown in FIG. 15 and the laptop computer 150 shown in FIG. 14 is the position in which the UWB antenna apparatus 100 (100A, 100B) is mounted. In FIG. 15, the UWB antenna apparatus 100 (100A, 100B) is mounted vertically to a high part of the edge of the liquid crystal display apparatus 155 where the laptop personal computer 150 is in an upright state. By having the longitudinal side the UWB antenna apparatus 100, 100B or 100C oriented vertically along the frame 156, the UWB antenna apparatus 100, 100B or 100C can be assembled in the laptop personal computer 150 without overlapping the liquid crystal panel 157.

Accordingly, transmission of radio waves 70 to the front direction of the liquid crystal panel 157 and reception of radio waves 80 from the front direction of the liquid crystal panel 157 can be prevented from being obstructed by the liquid crystal panel 157.

Seventh Embodiment

Figure 16:
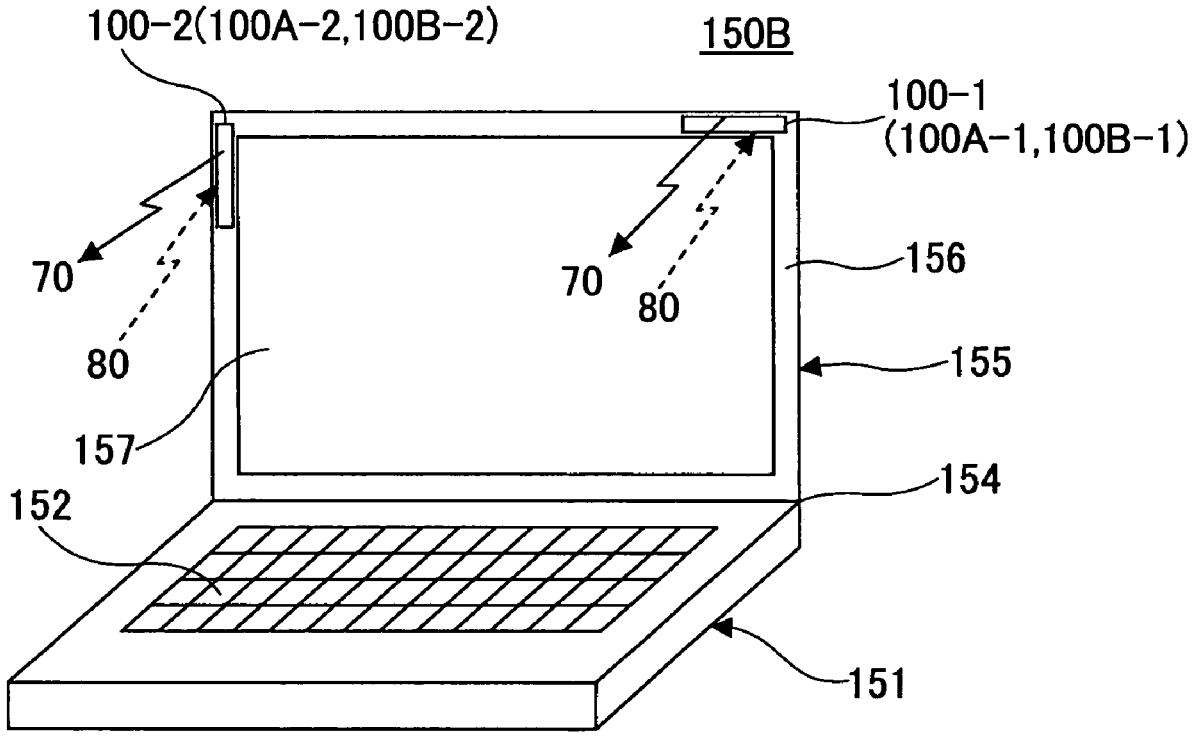
FIG. 16 is a schematic diagram showing a laptop type personal computer according to a seventh embodiment of the present invention.

FIG. 16 is a schematic diagram showing a laptop personal computer 150B according to a seventh embodiment of the present invention. The laptop computer 150B has a first UWB antenna apparatus 100-1 (100A-1, 100B-1) and a second UWB antenna apparatus 100-2 (100A-1, 100B-2) mounted to two parts of the edges of the liquid crystal display apparatus 155 (in this example, a left side part and an upper right part). The first UWB antenna apparatus 100-1 (100A-1, 100B-1) has its longitudinal side oriented sideways along the frame 156 and the second UWB antenna apparatus 100-2 (100A-1, 100B-2) has its longitudinal side oriented vertically along the frame 156. By arranging the first UWB antenna apparatus 100-1 (100A-1, 100B-1) and the second UWB antenna apparatus 100-2 (100A-1, 100B-2) in this manner, polarization or spatial diversity can be attained. Therefore, reliable data communications can be achieved even where the laptop personal computer 150C is used under severe environmental conditions.

Eighth Embodiment

Figure 17A:
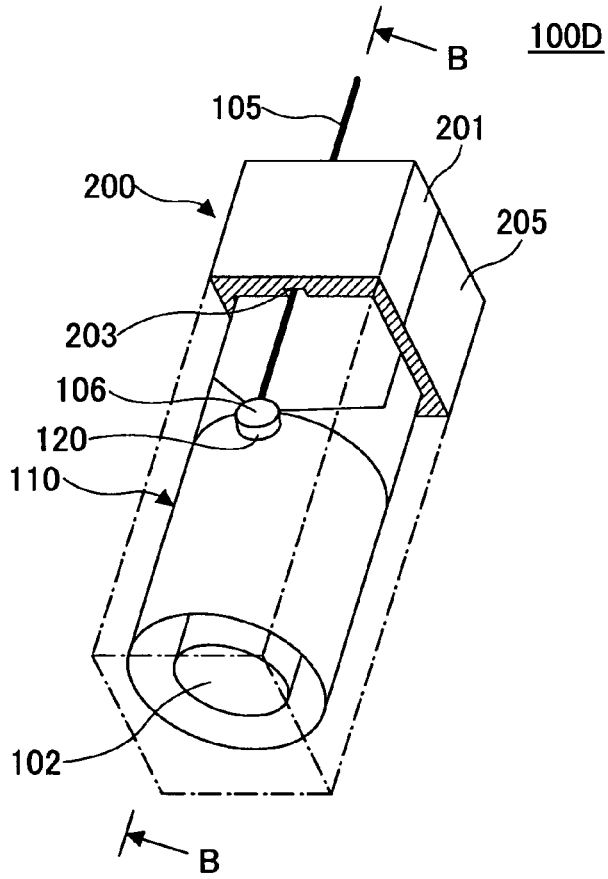
FIGS. 17A-17B are schematic diagrams showing a UWB antenna apparatus according to a eighth embodiment of the present invention.
Figure 17B:
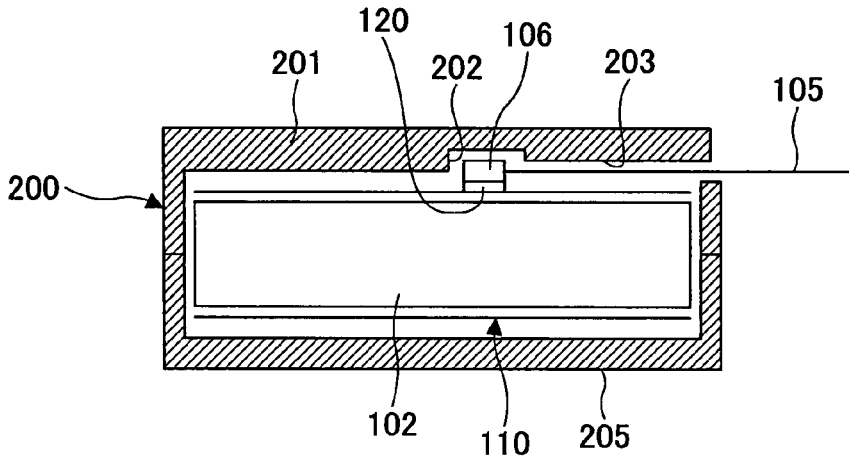

FIGS. 17A, 17B, and 18A-18F are schematic diagrams for describing a case type UWB antenna apparatus 100D according to an eighth embodiment of the present invention. The case type UWB antenna apparatus 100D has a configuration in which the UWB antenna apparatus 100 shown in FIGS. 4A-4E is housed inside a rectangular parallelepiped case 200 formed of a synthetic resin material. As shown in FIGS. 17A and 17B, a coaxial cable 105 is drawn out from the case 200.

Next, a method of manufacturing the case type UWB antenna apparatus 100D according to the eight embodiment of the present invention is described with reference to FIGS. 18A-18F.

Figures 18A, 18B, 18C, 18D, 18E, 18F:
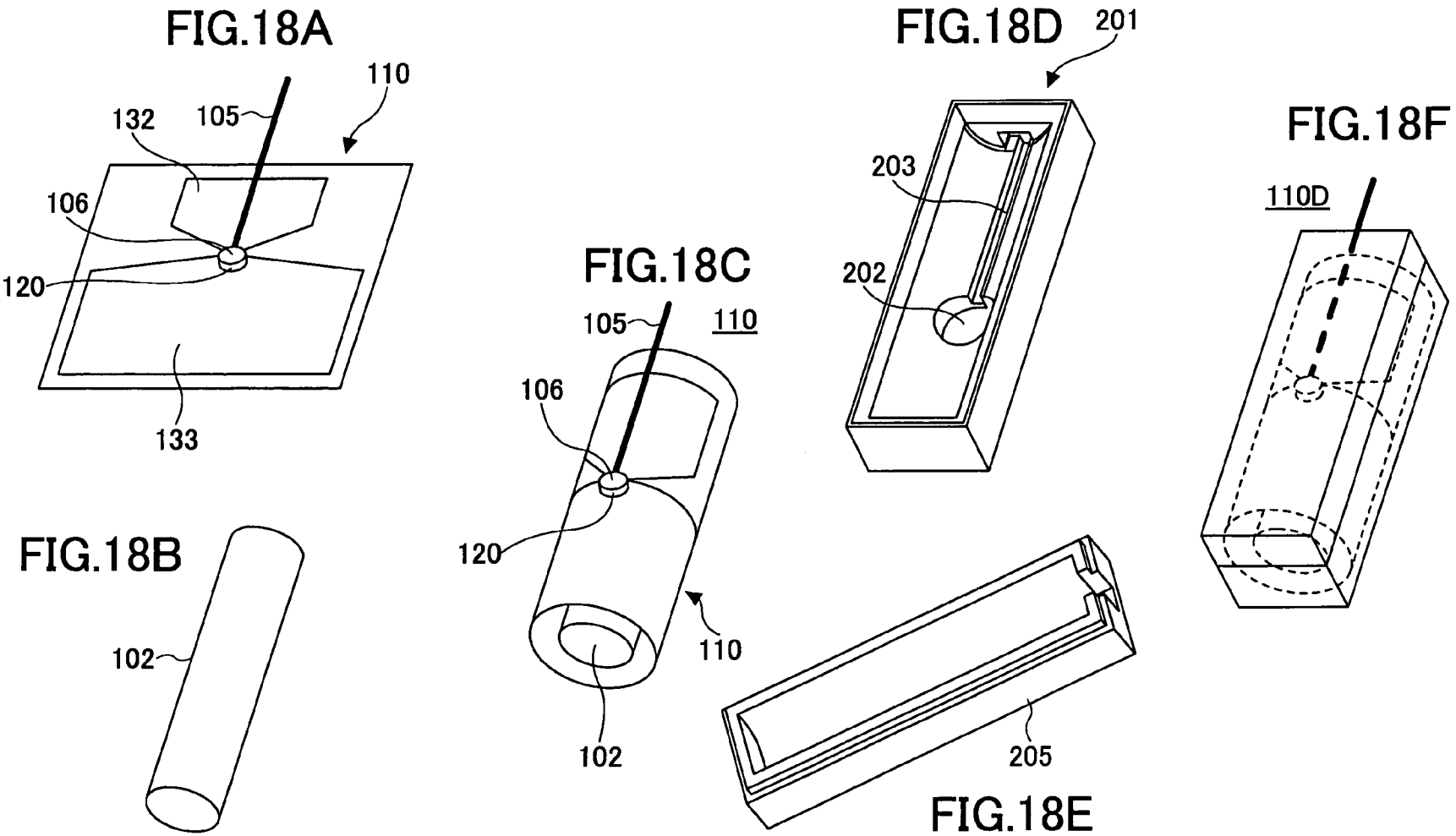
FIGS. 18A-18F are schematic diagrams for describing a process of manufacturing the UWB antenna apparatus shown in FIGS. 17A-17B.
Figure 19A:
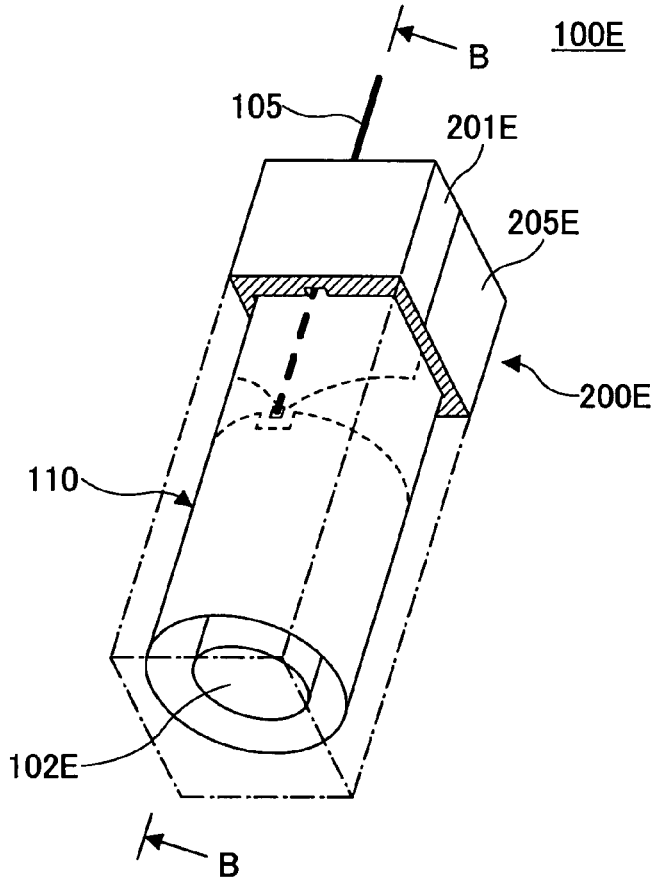
FIGS. 19A-19B are schematic diagrams showing a UWB antenna apparatus according to a ninth embodiment of the present invention.
Figure 19B:
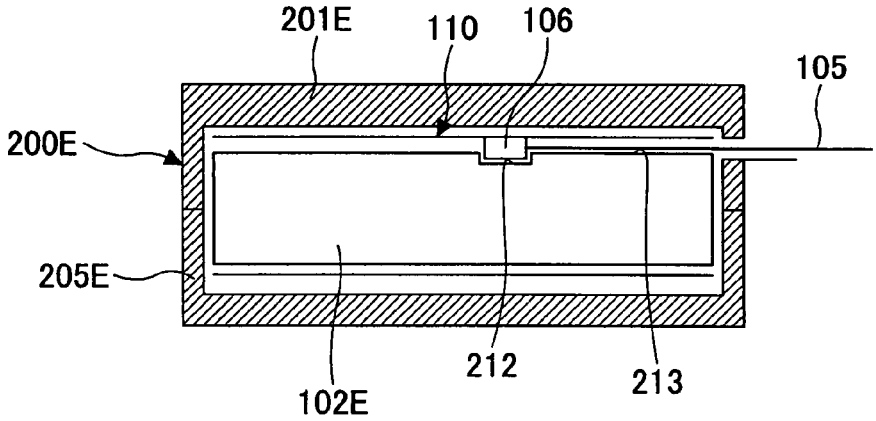

FIG. 18A shows a flat UWB antenna 110 (substantially the same as the one shown in FIG. 6A). As shown in FIG. 18A, a plug type coaxial connector 106 on one end of the coaxial cable 105 is connected to a socket type coaxial connector 120. FIG. 18B shows a core member 102 (substantially the same as the one shown in FIG. 7A). FIG. 18D shows an upper half part 201 of the case 200 (hereinafter referred to as "upper half case 201"). The upper half case 201 has a concave part 202 for installing the coaxial connector 106 therein and a groove part 203 for installing the coaxial cable 105 therein. FIG. 18E shows a lower half part 205 of the case 200 (hereinafter referred to as "lower half case").

The flat UWB antenna 110 shown in FIG. 18A is wrapped around the core member 102 shown in FIG. 18B in a manner shown in FIG. 18C to thereby form a rolled body. The rolled body is placed inside the upper half case 201 by engaging the plug type coaxial connector 106 to the concave part 202 and the coaxial cable 105 in the groove part 203. Then, the lower half case 205 is engaged to the upper half case 201 to serve as a lid that seals the rolled body inside the case 200. Thereby, the case type UWB antenna apparatus 100D is completed. With such a configuration, the UWB antenna apparatus 100D can be protected by the case 200.

For example, the case type UWB antenna apparatus 100D may be used by having one end of its coaxial cable 105 connected to a wireless terminal of an electronic device and attaching the case 200 to a desired part of the electronic device with a double face adhesive tape.

Ninth Embodiment

Next, a case type UWB antenna apparatus 100E according to a ninth embodiment of the present invention is described with reference to FIGS. 19A, 19B, and FIGS. 20A-20D. The case type UWB antenna apparatus 100E is different from the above-described case type UWB antenna apparatus 100D in that the flat UWB antenna 110 is wrapped around a core member 102E having the coaxial cable 105 and the coaxial connectors 106, 120 facing inward (towards the inside of the antenna apparatus 100*e*).

Figure 20D:
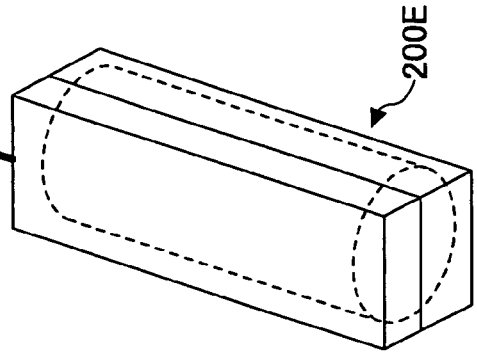
FIG. 20 are schematic diagrams for describing a process of manufacturing the UWB antenna apparatus shown in FIGS. 19A-19B.
Figure 20C:
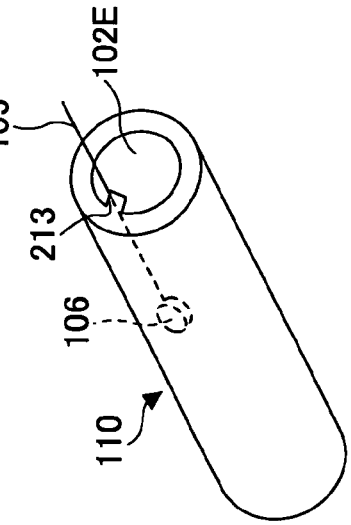
Figure 20A:
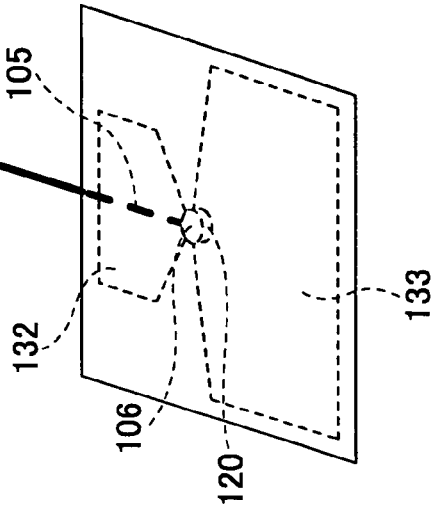
Figure 20B:
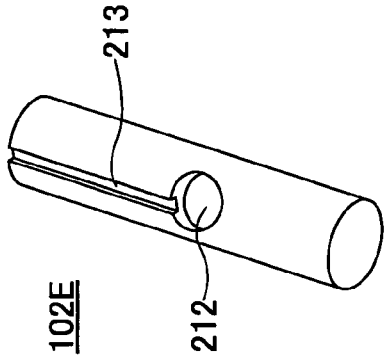

As shown in FIG. 20B, the core member 102E has a concave part 212 for installing the coaxial connector 106 therein and a groove part 213 for installing the coaxial cable 105 therein.

As shown in FIG. 20A, the flat UWB antenna 110 is formed having the coaxial cable 105 and the coaxial connectors 106, 120 provided on the back surface of the flat UWB antenna 110. As shown in FIG. 20C, the flat UWB antenna 110 is wrapped around the core member 102E by engaging the plug type connector 106 into the concave part 212 and engaging the coaxial cable 105 into the groove part 213. The rolled body is placed inside the upper half case 201E. Then, the lower half case 205E is engaged to the upper half case 201E to serve as a lid that seals the rolled body inside the case 200E. Thereby, the case type UWB antenna apparatus 100E is completed.

With the UWB antenna apparatus according to the ninth embodiment of the present invention, the presence of the coaxial cable 105 will not obstruct the process of assembling the UWB antenna apparatus to a given electronic apparatus to thereby facilitate assembly.

It is to be noted that, although the UWB antenna apparatus according to the above-described embodiments of the present invention has a cylindrical shape, the cross section of the cylindrical shape is not limited to a closed-loop curved shape such as a circular shape or an elliptical shape. The cross section of the cylindrical shape of the UWB antenna apparatus may be an open-loop shape such as a U-shape or a partly disconnected circular or elliptical shape.

Further, the present invention is not limited to these embodiments, but variations and modifications may be made without departing from the scope of the present invention.

The present application is based on Japanese Priority Application No. 2006-222849 filed on Aug. 18, 2006, with the Japanese Patent Office, the entire contents of which are hereby incorporated by reference.

What is claimed is:

1. An antenna apparatus comprising:

a dielectric flexible base having an antenna element pattern and a ground pattern formed thereon;

wherein the dielectric flexible base has a cylindrical shape encompassing an antenna axis;

wherein the antenna element pattern and the ground pattern formed on the dielectric flexible base are symmetrically formed with respect to the antenna axis;

wherein the antenna pattern includes a concave part; and wherein the ground pattern includes a protruding part having an end positioned inside the concave part.

2. The antenna apparatus as claimed in claim 1, wherein both ends of the antenna element pattern in the width direction are not overlapped.

3. The antenna apparatus as claimed in claim 1, wherein the antenna element pattern has a length that is substantially 1.5 times the width of the antenna element pattern.

4. An antenna apparatus comprising:

a dielectric flexible base having an antenna element pattern and a ground pattern formed thereon;

wherein the dielectric flexible base has a cylindrical share encompassing an antenna axis;

wherein the antenna element pattern and the ground pattern formed on the dielectric flexible base are symmetrically formed with respect to the antenna axis, further comprising:

a case for installing the antenna apparatus therein;

wherein the ground pattern includes a concave part; and wherein the antenna pattern includes a protruding part having an end positioned inside the concave part.

5. An electronic apparatus comprising:

the antenna apparatus as claimed in claim 1.

6. An electronic apparatus comprising:

an antenna apparatus comprising:

a dielectric flexible base having an antenna element pattern and a ground pattern formed thereon;

wherein the dielectric flexible base has a cylindrical shape encompassing an antenna axis;

wherein the antenna element pattern and the ground pattern formed on the dielectric flexible base are symmetrically formed with respect to the antenna axis, further comprising:

a main body including an upper surface on which a keyboard is provided;

a display apparatus pivotally movably mounted to the main body;

wherein the antenna apparatus is mounted to an edge part of the display apparatus.

* * * * *

UNITED STATES PATENT AND TRADEMARK OFFICE

CERTIFICATE OF CORRECTION

PATENT NO. : 8,094,077 B2
APPLICATION NO. : 11/717187
DATED : January 10, 2012
INVENTOR(S) : Masahiro Yanagi et al.

It is certified that error appears in the above-identified patent and that said Letters Patent is hereby corrected as shown below:

In Claim 1, Column 11, lines 18-20, delete the words "wherein the antenna pattern includes a concave part; and wherein the ground pattern includes a protruding part having an end positioned inside the concave part." and insert -- wherein the ground pattern includes a concave part; and
wherein the antenna pattern includes a protruding part having an end positioned inside the concave part. --.

In Claim 4, Column 12, line 1, delete the word "share" and insert the word -- shape --.

Signed and Sealed this
Tenth Day of April, 2012

David J. Kappos

David J. Kappos
*Director of the United States Patent and Trademark Office*